US008899784B2

(12) United States Patent
Meyer et al.

(10) Patent No.: US 8,899,784 B2
(45) Date of Patent: Dec. 2, 2014

(54) DISPLAY BOX LIGHTING MODULE

(75) Inventors: Aaron Meyer, Ventura, CA (US); Timothy Drew Ferrie, Ojai, CA (US); Bruce Quaal, Ventura, CA (US)

(73) Assignee: The Sloan Company, Inc., Ventura, CA (US)

( * ) Notice: Subject to any disclaimer, the term of this patent is extended or adjusted under 35 U.S.C. 154(b) by 227 days.

(21) Appl. No.: 13/429,170

(22) Filed: Mar. 23, 2012

(65) Prior Publication Data

US 2013/0077300 A1 Mar. 28, 2013

Related U.S. Application Data

(60) Provisional application No. 61/467,324, filed on Mar. 24, 2011.

(51) Int. Cl.

| | |
|---|---|
| ***F21V 1/00*** | (2006.01) |
| ***G09F 13/28*** | (2006.01) |
| ***F21V 5/04*** | (2006.01) |
| ***F21K 99/00*** | (2010.01) |
| ***F21S 2/00*** | (2006.01) |
| ***F21S 4/00*** | (2006.01) |
| *G09F 13/22* | (2006.01) |
| *F21Y 101/02* | (2006.01) |

(52) U.S. Cl.

CPC . *G09F 13/28* (2013.01); *F21V 5/04* (2013.01); *F21K 9/50* (2013.01); *F21S 2/005* (2013.01); *G09F 2013/222* (2013.01); *F21Y 2101/02* (2013.01); *F21S 4/008* (2013.01)

USPC ..... 362/240; 362/311.02; 362/249.01

(58) Field of Classification Search

USPC ..... 362/311.02, 249.01–249.19, 234–240

See application file for complete search history.

(56) References Cited

U.S. PATENT DOCUMENTS

| | | | | |
|---|---|---|---|---|
| 5,697,175 | A | 12/1997 | Schwartz | 40/552 |
| 6,042,248 | A | 3/2000 | Hannah et al. | 362/252 |
| 2007/0127230 | A1 | 6/2007 | Chung et al. | |
| 2009/0185374 | A1 * | 7/2009 | Wu et al. | 362/249.06 |
| 2010/0073928 | A1 | 3/2010 | Kim | |
| 2010/0118534 | A1 | 5/2010 | Lo | |
| 2011/0114977 | A1 | 5/2011 | Miura | |

FOREIGN PATENT DOCUMENTS

| | | |
|---|---|---|
| CN | 201535465 U | 7/2010 |
| DE | 20007314 U1 | 7/2000 |
| WO | WO 2010007835 | 1/2010 |

OTHER PUBLICATIONS

International Preliminary Report on Patentability and Written Opinion from PCT/US2012/030585, dated Oct. 3, 2013.

Koninklijke Philips Electronics N.V. Phillips, Inc. [retrieved on Sep. 27, 2012]. [online]. Retrieved on the Internet: URL:http://www.usa.lighting.philips.com/index.wpd.

Search Report and Written Opinion from PCT Application No. PCT/US2012/030585, dated Oct. 5, 2012.

* cited by examiner

*Primary Examiner* — Anne Hines

(74) *Attorney, Agent, or Firm* — Koppel, Patrick, Heybl & Philpott

(57) ABSTRACT

A lighting system comprising a system housing, a plurality of lighting units and first and second conductors electrically connected to said plurality of lighting units. The lighting units comprising a housing including a top portion and a bottom portion, a plurality of light emitting elements on a printed circuit board (PCB) within said housing. The top portion and bottom portion adapted to be coupled together to form the housing and form a seal to protect the components within the housing. The top portion further configured to comprise light altering characteristics so as to direct and shape emitted light from the plurality of light emitting elements.

36 Claims, 7 Drawing Sheets

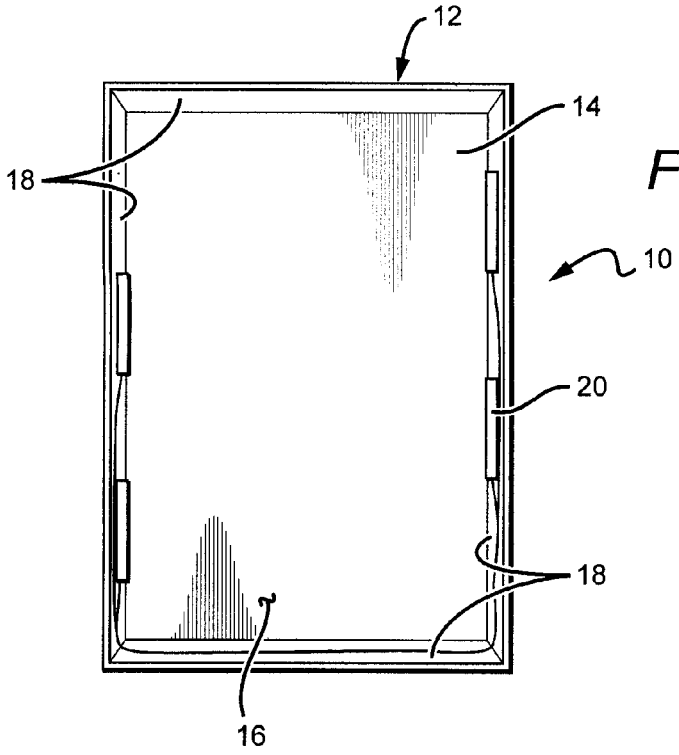
FIG. 1
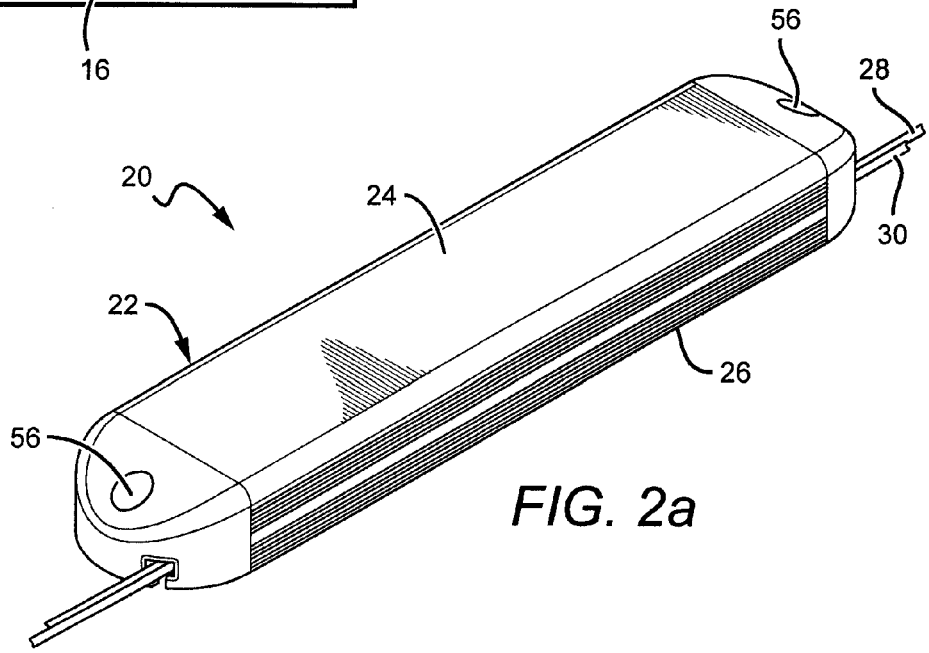
FIG. 2a
FIG. 2b
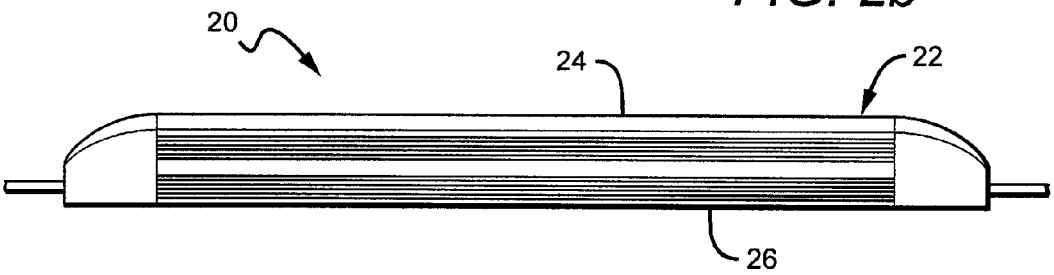

FIG. 3a
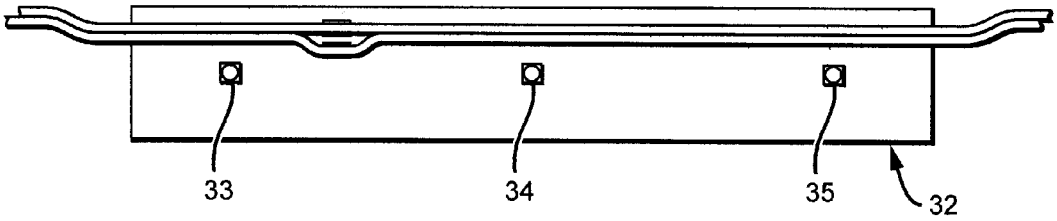
FIG. 3b
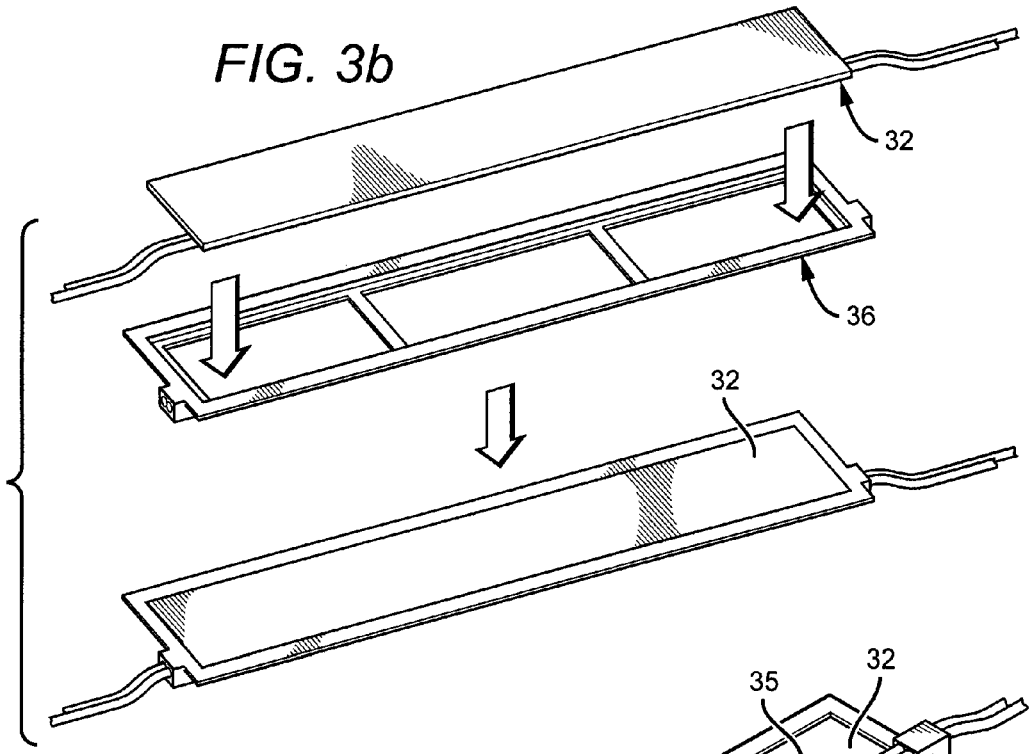
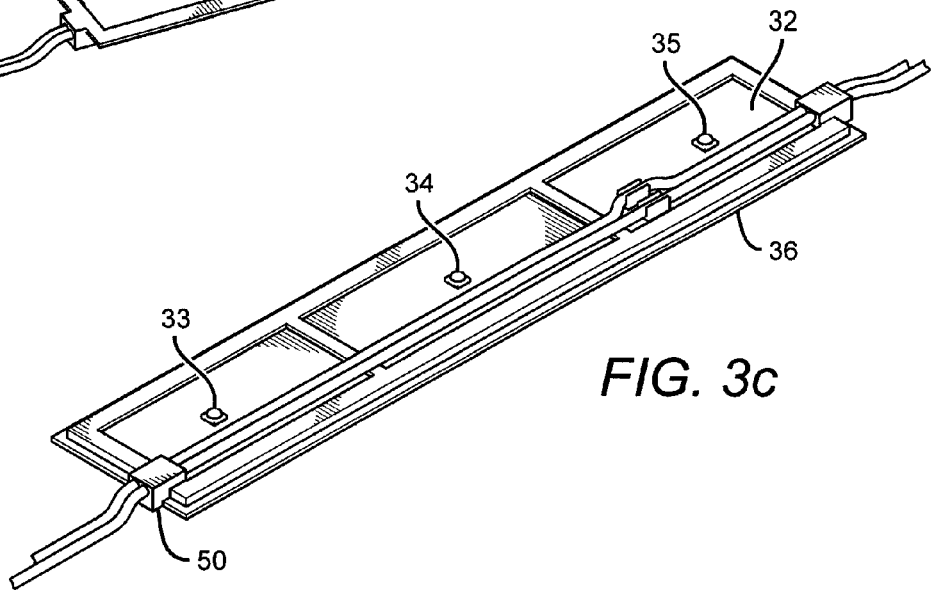
FIG. 3c

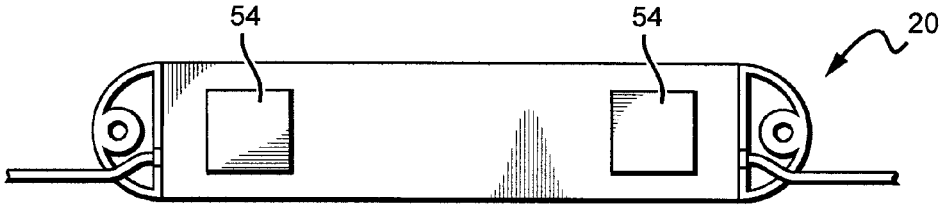
FIG. 5
FIG. 6a
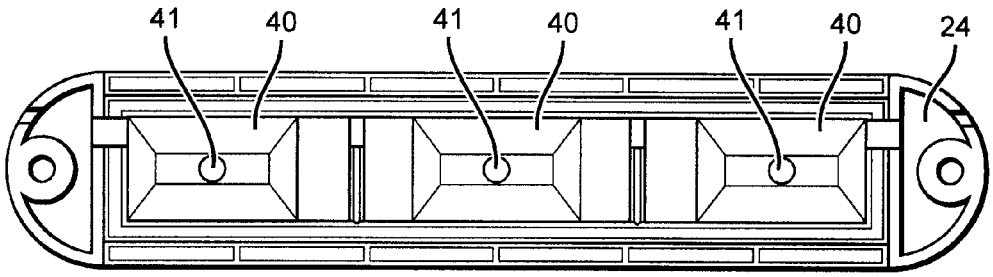
FIG. 6b
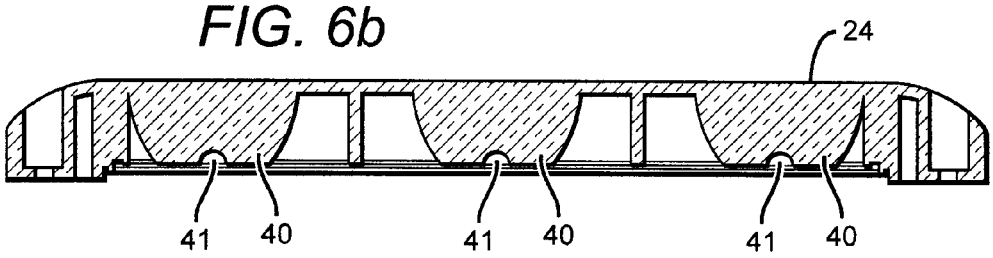
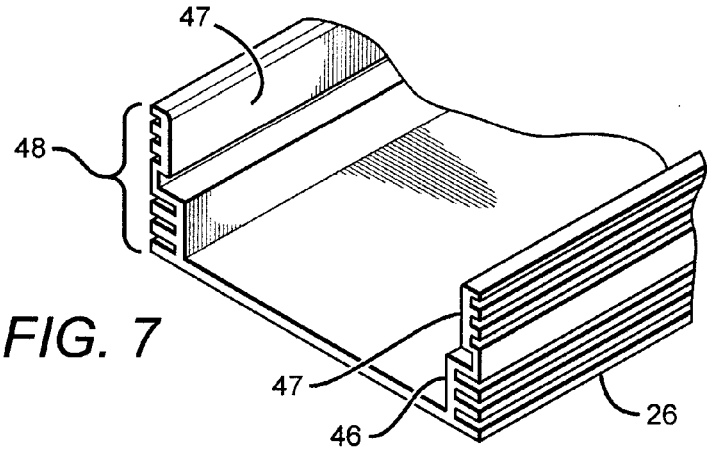
FIG. 7

FIG. 8a
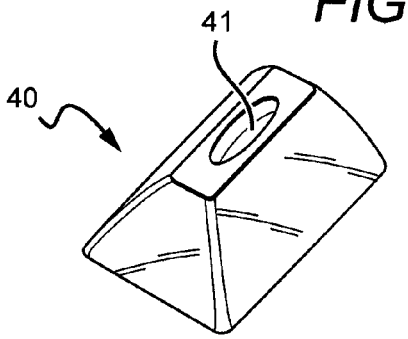
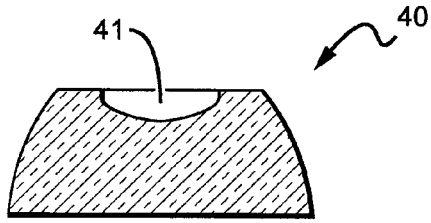
FIG. 8b
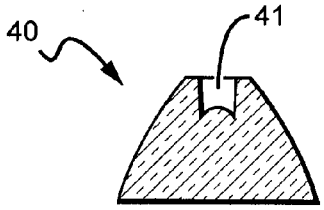
FIG. 8c
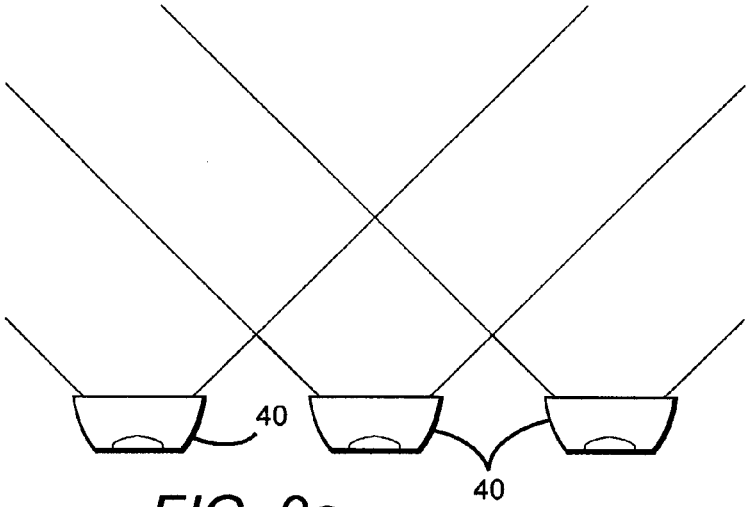
FIG. 9a
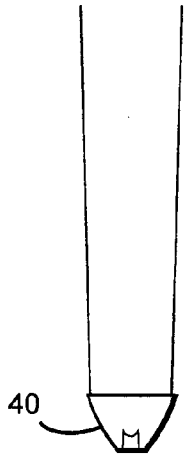
FIG. 9b FIG. 10a
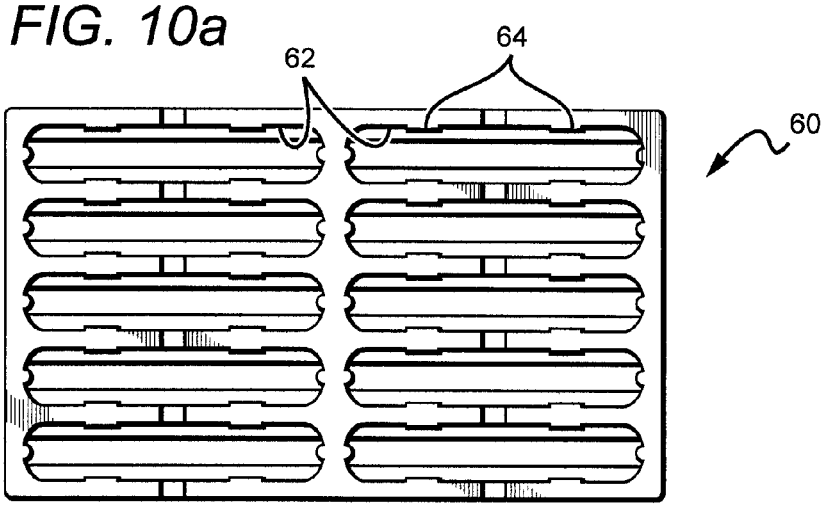
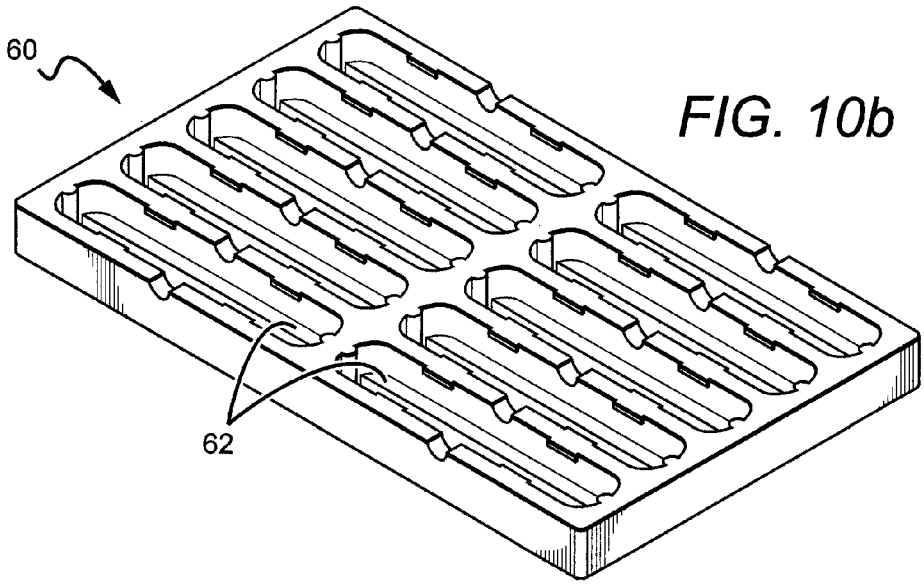
FIG. 10b
FIG. 10c
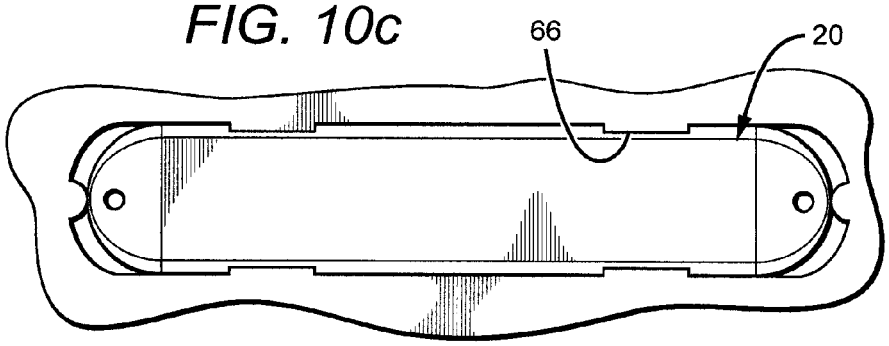

DISPLAY BOX LIGHTING MODULE

RELATED APPLICATION

This application claims the benefit of priority of U.S. Provisional Application Ser. No. 61/467,324, filed on Mar. 24, 2011.

BACKGROUND OF THE INVENTION

1. Field of the Invention

This invention relates to lighting systems using light emitting diodes (LEDs) and more particularly to LED based lighting units for illuminating display boxes.

2. Description of the Related Art

Display units, such as light boxes, cabinet signs and box signs are commonly found on the outside of buildings or businesses and are often used to advertise the name of the business or products. Typical units are constructed of aluminum or plastic housing having the shape of a box and are approximately 5" deep. The housing sometimes has a swing open frame to allow for easily changing the advertising graphics within. The top opening in the housing, or surface, is covered by a translucent or clear lens that transmits light from within the housing. The advertisement graphic is placed under this lens so that it is between the lens and the lighting units inside the light box. This allows the graphic to be illuminated from behind by the lighting units within the light box. In some cases the translucent lens itself may be the illuminated graphic.

Some light boxes or sign cabinets have graphics on one side and light only illuminates that side, whereas others are double-faced such that the two opposite sides of the light box each have a translucent or clear lens with a graphic and lighting inside the light box or sign cabinet illuminates both these sides and graphics.

To enhance the visibility of the advertisement within these units, different types of lighting are incorporated. Various types of lighting systems are used with different light sources such as incandescent bulbs, neon bulbs or fluorescent tubes. One of the problems associated with the conventional lighting units and systems is that their light sources can experience relatively short lifespans and they can have relatively low electrical efficiency. Incandescent bulbs, neon bulbs and fluorescent tubes have a relatively short lifespan, particularly when compared to other light sources, such as typical LEDs. These light sources are also electrically inefficient and providing sufficient lighting, especially in large lighting applications, requires the consumption of significant energy. For example, a standard fluorescent tube 60 inches in length consumes as much as 60 to 70 Watts, and conventional display units can utilize many of these tubes. Neon bulbs can also experience difficulty with cold starting, which can lead to failure of the neon bulb.

More recently, with the advent of the efficient solid state lighting sources, these display units have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with a vast majority of the electricity they consume being released as heat rather than light. Fluorescent light bulbs are more energy efficient than incandescent light bulbs, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1,000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours.

The increased efficiency and extended lifetime of LEDs is attractive to many lighting suppliers and has resulted in LED lights being used in place of conventional lighting in different sign applications. For example, U.S. Pat. No. 5,697,175 to Schwartz, discloses a low power illuminated sign that is particularly adapted for use with common EXIT signs over doorways. The back of each sign comprises a reflector with a series of cavities with curved surfaces. Each cavity corresponds to a letter and background area in the sign. LEDs are mounted in the center of the cavities to illuminate the letters or background area. The LEDs are provided on a separate perpendicular circuit board or on a central projection formed in the bottom of the cavities, with light from the LEDS directed outward. The letters and background area of the sign are illuminated by light reflecting forward from the curved surfaces of the cavities, so that the only visible light is from the illumination of the cavities.

U.S. Pat. No. 6,042,248, to Hannah et al., discloses an LED assembly for channel letter illuminating signs having an enclosure/housing covered by a translucent lens. Each sign includes a plurality of track moldings at the base of its enclosure, with the moldings running along the longitudinal axis of the sections of the channel letter. Linear arrays of LEDs are mounted on printed circuit boards (PCBs) that are then mounted in the track moldings. Each track molding can hold two PCBs in parallel with each of the PCBs arranged on a longitudinal edge, with the LEDs directed outward.

LED based display case or box lighting is also available from Philips Electronics, under the brand name Affinium, which comprises modules containing 3 or 6 LEDs with separate features such as lenses mounted over each of the LEDs. The LEDs and features are enclosed in a housing. The LED modules are mounted inside a display cases to hold the LEDs in place.

In these and similar lighting units generally reflectors or lenses are used over the light emitters to direct their lights. Generally, these lens or reflector features are individually placed over each light emitter making the units difficult and costly to assemble because of the need to place multiple features. Also, these units are more complex and difficult to seal.

SUMMARY

The invention provides various embodiments of a lighting unit, systems and methods of manufacturing the same. The invention is configured to be efficient, reliable, cost effective and can be arranged to provide illumination for structural lighting, display lighting and ingress/egress lighting, and is particularly applicable for light boxes or sign cabinet lighting. The different embodiments comprise elements to alter or control the light distribution pattern emitted from the light sources within the lighting unit. The elements can comprise many different materials or devices arranged in different ways, with some devices comprising a plurality of electrically connected LEDs.

In one embodiment, as broadly described herein, a lighting system is disclosed that comprises a system housing including a front surface and a back surface, a plurality of lighting units mounted within the system housing. The lighting system further comprises first and second conductors which are electrically connected to the plurality of lighting units. The plurality of lighting units can be mounted within the system housing such that they are interconnected in a daisy chain configuration or each of the lighting units can be individually connected to a respective first and second conductors.

The lighting unit comprises a housing including a top portion and a bottom portion, a plurality of light emitting elements, a printed circuit board (PCB) within the housing, wherein the plurality of light emitting elements are mounted on the PCB. The lighting unit further comprises conductors to provide an electrical current to each of the light emitting elements. The light emitting elements are adapted to emit light in a direction away from the housing, in response to the electrical current supplied by the conductors. The lighting units can further comprise a mounting mechanism to mount the lighting units within the system housing.

In another embodiment, the lighting unit comprises a housing including a top portion and a bottom portion, wherein the top portion comprises light altering properties. The lighting units further comprise a plurality of light emitting elements mounted on a PCB within the housing, and a gasket interposed between the top potion and the bottom portion of the housing, such that coupling the top and bottom portions of the housing forms a seal to protect the internal components of the lighting unit. The PCB and/or the housing can be configured to conduct and dissipate heat from the light emitting elements. The lighting unit can also be configured to be received by a mounting mechanism so as to mount the lighting unit to the system housing or the like.

These and other aspects and advantages of the invention will become apparent from the following detailed description and the accompanying drawings which illustrate by way of example the features of the invention.

BRIEF DESCRIPTION OF THE DRAWINGS

FIG. 1 is a perspective view of a lighting system according to an embodiment of the invention;

FIG. 2*a* is a perspective view of a lighting unit according to an embodiment of the invention;

FIG. 2*b* is a side view of the lighting unit shown in FIG. 2*a;*

FIG. 3*a* is a top view of the lighting unit according to an embodiment of the invention;

FIG. 3*b* is an exploded view of the lighting unit according to an embodiment of the invention;

FIG. 3*c* is a perspective view of the lighting unit shown in FIG. 3*b;*

FIG. 5 is a bottom view of a lighting unit according to an embodiment of the invention;

FIG. 6*a* is a bottom view of the lighting unit according to an embodiment of the invention;

FIG. 6*b* is a cross-sectional view of the lighting unit shown in FIG. 6*a* at line A-A;

FIG. 7 is a perspective view of the lighting unit according to an embodiment of the invention;

FIG. 8*a* is perspective view of a lighting unit according to an embodiment of the invention;

FIG. 8*b* is a side view of the lighting unit shown in FIG. 8*a;*

FIG. 8*c* is another side view of the lighting unit shown in FIG. 8*a;*

FIG. 9*a* is a view of beam patterns of the housing according to an embodiment of the invention;

FIG. 9*b* is another view of beam patterns of the housing according to an embodiment of the invention;

FIG. 10*a* is a top view of an embodiment of packaging according to the present invention;

FIG. 10*b* is a perspective view of an embodiment of packaging according to the present invention;

FIG. 10*c* is a top view of an embodiment of a portion of packaging with a unit according to the present invention;

DETAILED DESCRIPTION

Figure 2C:
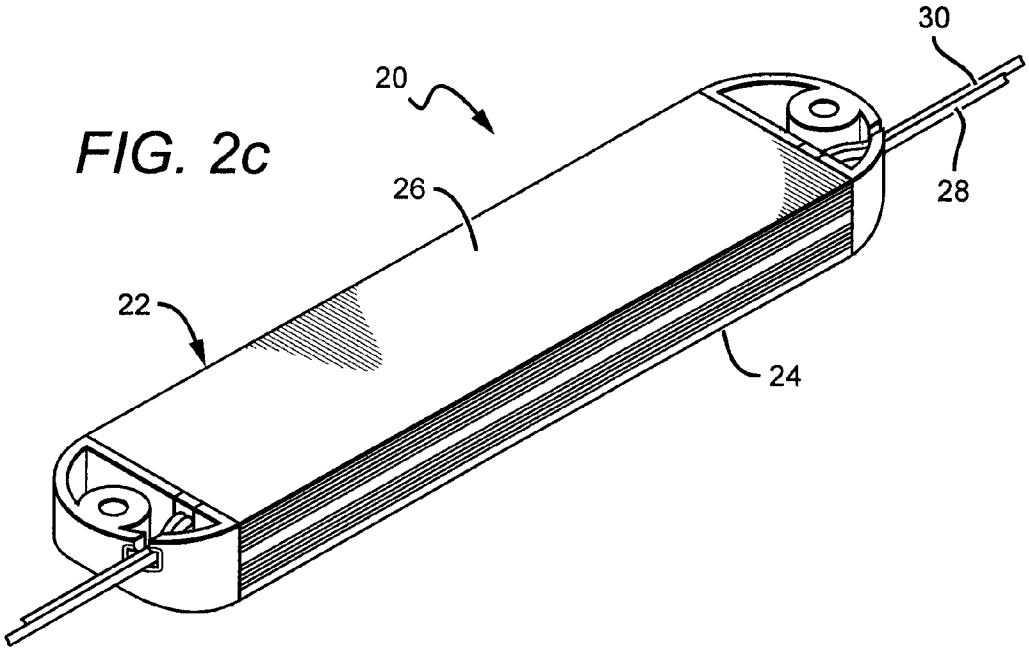
FIG. 2*c* is a bottom view of the lighting unit shown in FIG. 2*a;*

The invention described herein is directed to different embodiments of a lighting system that can be used in many different applications such as but not limited to structural lighting, display lighting and ingress/egress lighting, cabinet signs, cabinet boxes, cabinet cases, menu boards, monument signs, display signs, poster boxes, display boxes, but is particularly applicable to display case lighting. Embodiments herein may be described in reference to poster boxes, however these embodiments are applicable to any of the different applications listed above. In some embodiments, the lighting system comprises a system housing and a plurality of lighting units, wherein each of the lighting units can be configured to have their own electrical conductors or can be interconnected in a chain configuration by the electrical conductors. An electrical signal applied to an input end of the conductors spreads to the lighting unit or units, causing them to emit light. The lighting unit can be mounted in various locations within the system housing.

According to an embodiment of the invention, the lighting units comprise a housing including a top portion and a bottom portion, a plurality of light emitting elements on a printed circuit board (PCB), wherein the PCB is disposed in housing. The light emitting elements are disposed within the housing in such a manner that they are aligned with a respective lens that is integral to the top portion of the housing. In this configuration, the top portion of the housing can be formed as a single molded piece comprising the respective lenses which is coupled to the bottom portion of the housing such that the light emitting elements are received by the respective lens. The housing can be further adapted to seal the plurality of light emitting elements and PCB from the environment. In some embodiments, the housing can be filled with a sealant which allows for the lighting units to be customized in accordance with a particular application. For example, in poster box applications there may be instances where weatherproofing or additional ruggedness may be desired, and the invention allows for the sealing or additional ruggedness to be altered, by the use of different housing or filler materials, meeting the needs of different applications.

Poster boxes and sign cabinet lighting are generally known in the art and are typically used to illuminate an advertisement or signage within the poster box or sign cabinet. Conventional poster boxes/sign cabinets comprise a housing, a light source, electronic components to power the light source and a transparent cover. Typical light sources for these conventional poster boxes/sign cabinets are, for example, incandescent, neon or fluorescent bulbs. Conventional poster boxes/sign cabinets are normally mounted to a wall, suspended from a ceiling or mounted to a pole, whereas other conventional poster boxes/sign cabinets can be recessed into the wall such that the electronic components are within the wall. These poster boxes/sign cabinets can be big and bulky due to the physical dimensions of the necessary high power electronic components and the physical size of the light source. As such, the profile of the conventional poster boxes/sign cabinets mounted to or recessed in a wall can extend from the wall such that the poster box/sign cabinet is not aesthetically pleasing.

The lighting system of the invention can provide a number of additional advantages beyond those mentioned above. For example, in some embodiments the light emitting elements of the lighting units can be LEDs, which are physically smaller than fluorescent and incandescent bulbs typically used in the conventional poster boxes/sign cabinets, thereby reducing the profile of the lighting system. LEDs operate at a lower power level in comparison to fluorescent and incandescent bulbs and do not need similar high power electronic components, leading to smaller electronic components, a reduction in size of the system housing and overall weight of the lighting system. Also, in some embodiments, the housing of the lighting units includes features such as lenses or reflectors. These embodiments allow for manufacturing and placement of these features separately from the PCB and light emitting elements. Lens and/or reflector features may be placed in or be a part of a molded housing which is used for the light emitting surface. This placement is more economically efficient than direct placement of the lenses or reflectors on LEDs because both assembly and sealing of the module are simplified. For example, the top portion of the housing can be formed to include the lenses, such that the top portion and the lenses are one solid body. This allows for consistent reproducibility of the lighting unit at a large scale, which further ensures that the light emitting characteristics of different lighting units are consistent. In embodiments where lenses or reflectors are part of the housing, assembly is simplified because only one component must be placed rather than multiple individual lenses or reflectors. Also, having these features integrated into the housing simplifies sealing of the module.

The invention is described herein with reference to certain embodiments but it is understood that the invention can be embodied in many different forms and should not be construed as limited to the embodiments set forth herein. In particular, the invention is described with reference to certain embodiments where the light emitting elements are placed within a molded housing and sealed, but in other embodiments this configuration can be modified. The PCB and light emitting elements can be placed in the housing different methods. In addition the lighting units may be filled and sealed using a variety of materials. The invention can also be used with different types of lighting units used in different applications beyond poster box lighting, and although the invention is described herein with reference to light emitting diodes (LED or LEDs) other light sources can be used.

It is to be understood that when an element or component is referred to as being "on" another element or component, it can be directly on the other element or intervening elements may also be present. Furthermore, relative terms such as "between", "within", "adjacent", "below", "proximate" and similar terms, may be used herein to describe a relationship of one element or component to another. It is understood that these terms are intended to encompass different orientations of the device in addition to the orientation depicted in the figures.

Although the terms first, second, etc. may be used herein to describe various elements or components, these elements or components should not be limited by these terms. These terms are only used to distinguish one element or component from another. Thus, a first element discussed herein could be termed a second element without departing from the teachings of the present application. It is understood that actual systems or fixtures embodying the invention can be arranged in many different ways with many more features and elements beyond what is shown in the figures.

Embodiments of the invention are described herein with reference to illustrations that are schematic illustrations. As such, the actual thickness of elements and features can be different, and variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. An element illustrated or described as square or rectangular will typically have rounded or curved features due to normal manufacturing tolerances. Thus, the elements illustrated in the figures are schematic in nature and their shapes are not intended to illustrate the precise shape of a feature of a device and are not intended to limit the scope of the invention.

Figure 2D:
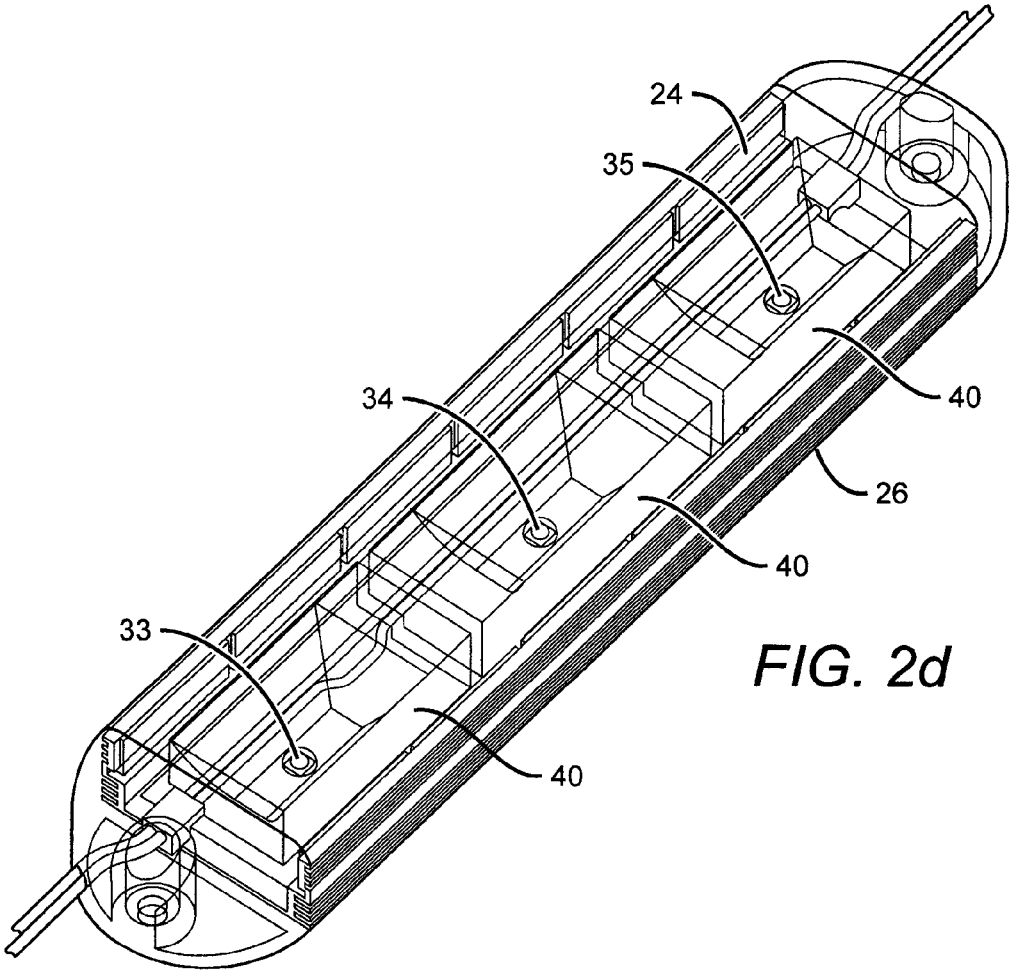
FIG. 2*d* is a semi-transparent view of the lighting unit shown in FIG. 2*a;*

FIGS. 1-2*c* show one embodiment of a lighting system 10 according to an embodiment of the invention which comprises a system housing 12 including a front surface 14, a back surface 16 opposite the front surface 14, a plurality of sidewalls 18 and a plurality of lighting units 20. The plurality of lighting units 20 can be configured to be wired separately or can be configured to be interconnected together in a daisy-chain configuration by first and second electrical conductors 28, 30. The lighting units 20 are mounted within the system housing 12. In some embodiments, the lighting units 20 are mounted on the sidewalls 18 of the system housing 12, such that the lighting units 20 on opposing sidewalls 18 are staggered from each of the other lighting units 20. This staggered configuration ensures that the lighting units 20 on opposing sidewalls 18 are not aligned in a face-to-face configuration, which could result in an increased light intensity in a concentrated area. In other embodiments, the lighting units 20 are mounted on only one of the sidewalls 18. An advantage of the lighting unit 20 is that it can also be installed in existing light boxes or poster boxes as a retrofit kit unit such that the lighting unit 20 replaces conventional light sources.

Each of the lighting units 20 comprise a plurality of light emitting elements. The light emitting elements may be arranged in many different ways. The lighting units 20 may have any number of light emitting elements, but the examples shown herein have 3 light emitting elements. First, second and third light emitting elements 33, 34, 35 (described below) emit light out from the lighting unit 20 in response to an electrical signal. The first and second electrical conductors 28, 30 conduct electricity to the lighting units 20 and an electrical signal applied to the conductors 28, 30 at one end of the lighting system 10 is conducted to each of the lighting units 20 so that the light emitting elements 33, 34, 35 on each of the lighting units 20 simultaneously emit light. The lighting units 20 are particularly adapted to be mounted in the system housing 12 or sign cabinet lighting, wherein the front surface 14 of the system housing 12 is the light emitting surface of the lighting system 10. In some embodiments, the lighting system 10 is configured to be mounted on a wall or similar structure, such that substantially all light is emitted out the front surface 14 of the system housing 12. In other embodiments, the lighting system 10 can be recessed mounted into a wall or similar structure, while in other embodiments the lighting system 10 can be mounted to a pole or other stand-alone structures.

The system housing 12 can be configured such that the front surface 14 is a transparent or translucent cover. The front surface 14 can be formed of plastic, tempered glass or the like. In embodiments where the front surface 14 comprises a translucent cover, the light emitted from the light emitting elements 33, 34, 35 can be reflected and/or diffused by the features on the light emitting elements 33, 34, 35, in the system housing 12 or the translucent cover, so as to give the appearance that the lighting system 10 is a continuous light source.

FIGS. 3*a*-9*b* show an embodiment of the lighting units 20 according to the invention, and disclose additional components or features that may be included in the lighting system 10. For the same or similar features, the same reference numbers will be used throughout the application herein. The lighting unit 20 comprises a housing 22, a plurality of light emitting elements 33, 34, 35, and a PCB 32 within the housing 22, wherein the plurality of light emitting elements 33, 34, 35 are mounted on the PCB 32. The housing 22 comprises a top portion 24 and a bottom portion 26, wherein the top portion 24 and the bottom portion 26 are adapted to be coupled together to form the housing 22. The top portion 24 can be made of many different materials such as conductive, semi-conductive, non-conductive materials or a combination thereof. In one embodiment, the top portion 24 is made of plastic and can be fabricated using many known processes such as, but not limited to, extrusion or injection molding.

The top portion 24 can be configured to have light altering and/or beam shaping properties in order to direct emitted light from the light emitting elements 33, 34, 35. In one embodiment, the top portion 24 comprises a plurality of lenses 40, wherein each one of the plurality of lenses 40 receives a respective light emitting element 33, 34, 35. The top portion 24 as a whole may be considered a lens having integrated lens portions for individual light emitters, as shown in FIGS. 6*a*-6*b*. In some embodiments, the plurality of lenses 40 are integral to the top portion 24 of the housing 22 and are not separate lens subsequently added to the housing 22. The plurality of lens 40 are designed to be placed over the light emitting elements 33, 34, 35 directing the light emitting from these light emitting elements 33, 34, 35 in a particular angle or direction. This angle or direction is determined, in part, by the size and depth of the system housing 12. In some embodiments, the plurality of lenses 40 are disposed on the PCB 32, while in other embodiments the plurality of lenses do not contact the PCB 32. The lens 40, as shown in FIGS. 8*a*-8*c*, are shown as having a trapezoid-like shape. However, the lens 40 is not intended to be limited to the shape disclosed in FIGS. 8*a*-8*c*. In other embodiments, the lens can be in the form of many different shapes, such as but not limited to cylindrical, spherical, hemi-spherical, pyramid, quadrilateral, multi-faceted and the like.

In some embodiments each of the plurality of lenses 40 have an opening 41 which is over and receives a respective one of the plurality of light emitting elements 33, 34, 35, as shown in FIGS. 6*a*-6*b*. In some embodiments the lenses 40 are configured to redirect light such that the light emitting elements 33, 34, 35 have an output aperture of up to 180 degrees in the longitudinal direction of the opposing sidewall 18 of the system housing 12, and an aperture of up to 90 degrees in the transverse direction. In other embodiments the light emitting elements 33, 34, 35 can have an output aperture of up to 120 degrees in the longitudinal direction of the opposing sidewall 18, and an aperture of up to 45 degrees in the transverse direction. In yet other embodiments, as shown in FIGS. 9*a*-9*b*, the light emitting elements 33, 34, 35 can have an output aperture of up to 90 degrees in the longitudinal direction of the opposing sidewall 18, and an aperture of up to 10 degrees in the transverse direction. These apertures provide substantially uniform lighting in the system housing 12 and in conventional poster boxes, more so than lights with smaller apertures, because apertures this size allow light to reflect and diffuse more effectively before being emitted out the system housing 12. The lens 40 can be configured to have smaller or larger apertures in either direction, in addition to the examples discussed herein and are not intended to be limited to the above examples. These apertures may be adjusted to provide uniform lighting in poster boxes of different sizes.

The PCB 32 has first, second and third light emitting elements 33, 34, 35 (shown in FIG. 3*a*) disposed on a surface of the PCB 32, and conductors 28, 30 are mounted or connected to the PCB 32. Many different connection methods can be used, with one suitable method being soldering. Another connection method can be using Insulation Displacement connectors (IDC) or Insulation Piercing connectors (IPC). The conductors 28, 30 electrically couple the signal on the conductors 28, 30 to their respective one of the lighting units 20. The PCB 32 can also comprise conductive traces (not shown) to conduct electrical signals from the conductors 28, 30 to the light emitting elements 33, 34, 35 so that an electrical signal applied to the first and second conductors 28, 30 is conducted to the light emitting elements 33, 34, 35 through the traces, causing the light emitting elements 33, 34, 35 to emit light.

The light emitting elements 33, 34, 35 are generally mounted along the longitudinal axis of the PCB 32, although they can also be mounted in other locations. In some embodiments the lighting units 20 can comprise more or less than three lighting elements, such as four, six, and eight or more, that can be mounted in many different locations. The light emitting elements 33, 34, 35 can be any device that emits light in response to an electrical signal, such as incandescent lights, lasers, laser diodes, fluorescent light, neon lights, or light emitting diodes (LEDs). The light emitting elements 33, 34, 35 can emit different colors of different intensities, with a suitable LED being commercially available emitting high luminous flux white light. One suitable LED would output 150 lumens per watt; however other LEDs can be used that have an output that is higher or lower. In some embodiments, light emitting elements 33, 34, 35 may not have lenses, have lenses built in, or they may be added later.

The PCB 32 can be any conventional type made from any conventional material. In one embodiment, the PCB 32 is a metal core type PCB 32. Different types of metal core boards can be used such as an aluminum core board; FR-4 PCBs may also be used. An advantage of the PCB 32 being formed of a metal core is that heat from the light emitting elements 33, 34, 35 can be conducted into the PCB 32 so that the PCB 32 helps draw away heat from the light elements 33, 34, 35. The PCB 32 then provides a larger surface area that allows the heat to dissipate into the surrounding ambient. This can help keep the light emitting elements 33, 34, 35 at a cooler temperature while in operation, which can allow the light emitting elements 33, 34, to operate under a higher current so that they can emit a higher luminous flux. Also, the light emitting elements 33, 34, may have an increased operating lifespan at a cooler operational temperature. In some embodiments, thermal vias (not shown) may be added through the PCB 32, such that the thermal vias are in thermal communication with the light emitting elements 33, 34, 35 to allow for better, more efficient heat transfer.

Lighting units according to the invention can also comprise other elements, with one embodiment comprising heat sinks to dissipate heat from the light elements. In another embodiment, the lighting units 20 comprise a power supply (not shown) electrically connected to conductors 28, 30. Power supplies are generally known in the art and are only discussed briefly herein. In one embodiment, the power supply is adapted to provide a constant current output. The power supply provides substantially the same drive current to the light emitting elements 33, 34, 35 so that the lighting unit 20 can emit a substantially constant light distribution pattern in accordance with the desired light emission. In some embodiments, the power supply can be installed remote to the lighting unit 20, whereas in other embodiments, the power supply can be mounted on or within the system housing 12. At least one advantage of the invention is that the power supply, while in operation, allows the plurality of lighting units 20 to provide and maintain the desired light output and prevents the lighting system 10 from exhibiting an undesirable light output, such as but not limited to different levels of light brightness, color variations or variations in the light distribution pattern. In yet other embodiments, the lighting unit 20 can comprise constant current drive circuitry electrically connected to the power supply in order to provide the same drive current to the light emitting elements 33, 34, 35.

Figure 4B:
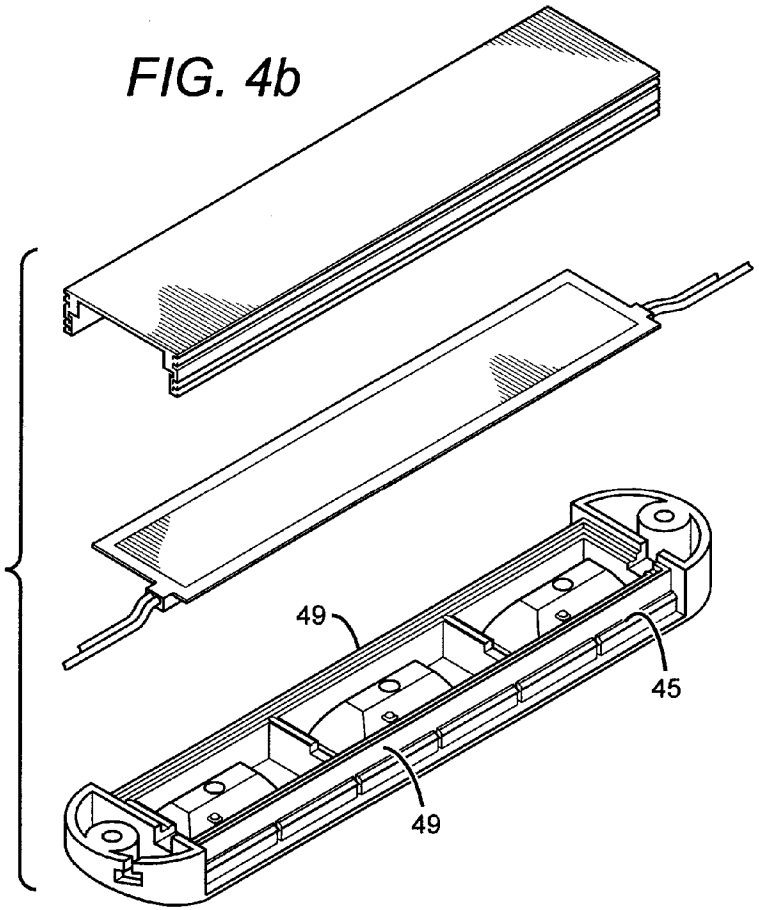
FIG. 4*b* is an exploded view of another embodiment of a lighting unit according to an embodiment of the invention.
Figure 4A:
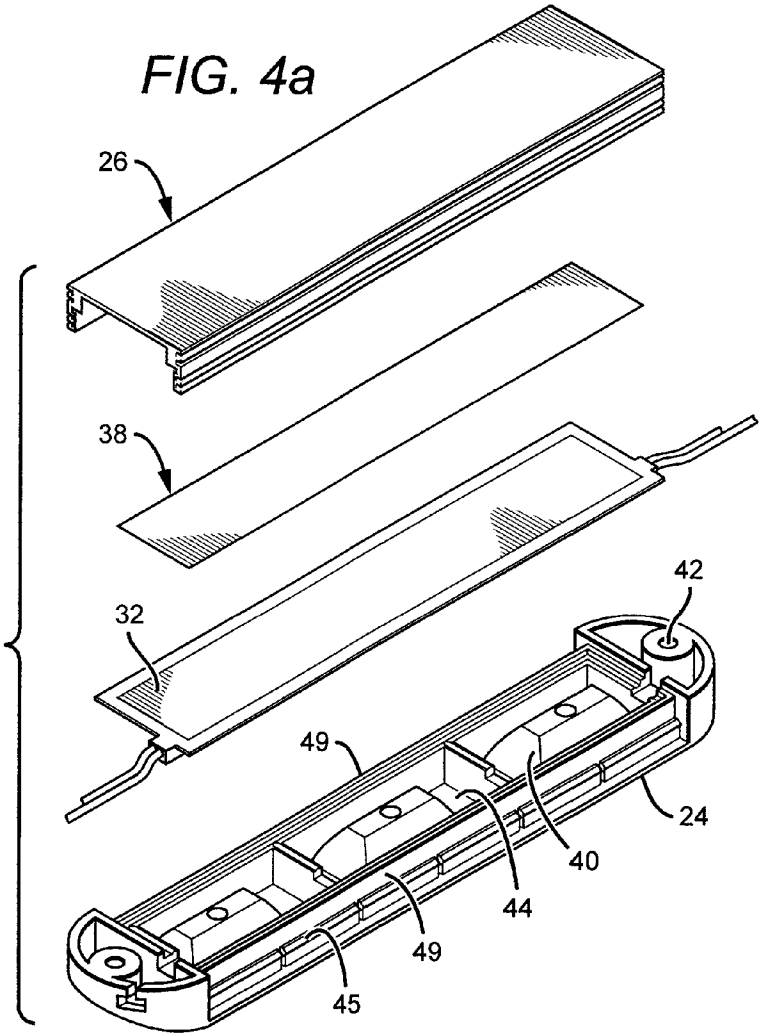
FIG. 4*a* is an exploded view of a lighting unit according to an embodiment of the invention.

In one embodiment, the PCB 32 with light emitting elements 33, 34, 35 and electrically connected conductors 28, 30 can be securely disposed within the housing 22 by coupling the top portion 24 of the housing 22 to the bottom portion 26 of the housing 22. For example, the bottom portion 26 can be snapped onto the top portion 24. In such an embodiment, the bottom portion 26, as shown in FIG. 7, comprises a longitudinal slot 46 on opposing bottom portion sidewalls 47, while the top portion 24, as shown in FIGS. 4*a*-4*b*, comprise extensions 45 extending from opposing top portion sidewalls 49. The longitudinal slots 46 of bottom portion 26 are configured to engage the extensions 45 of the top portion 24 in order to couple together the top portion 24 and the bottom portion 26 and to form a seal to protect the components within the housing 22. In other embodiments, a gasket 36 can be placed on the PCB 32 such that when the top portion 24 and the bottom portion 26 of the housing are coupled together the gasket 36 forms a weather-proof seal. The gasket 36 can be made of silicone or any other suitable material. In some embodiments the gasket 36 may have a hardness level of Shore A 20±5, but this may be adjusted and customized based on application and desired hardness or softness. The PCB 32 is received by the gasket 36 such that the gasket 36 covers the edges and sides of the PCB 32, as shown in FIG. 3*c*. The conductors 28, 30 are fed through gasket holes 50. Depending on the type of PCB 32, an insulation layer or heat transfer pad 38 may be placed on the PCB 32 opposite the light emitting elements 33, 34, 35, such that the insulation layer or heat transfer pad 38 is interposed between the bottom portion 26 and the PCB 32. For example, an aluminum core PCB may not require a dielectric insulation layer or heat transfer pad 38 (see FIG. 4*b*) but an FR-4 PCB may require a dielectric insulation layer or heat transfer pad 38 (see FIG. 4*a*).

Prior to coupling the bottom portion 26 to the top portion 24, the PCB 32, gasket 36, and heat transfer pad 38, if needed, are placed on the top portion 24. The PCB 32 may be oriented such that the conductors 28, 30 and the gasket holes 62 are placed in cavities 44 within the top portion 24. The conductors 28, 30 exit the top portion 24 through wire channels 52. An advantage of the invention is that the bottom portion 26 of the housing 22 can be made of thermally conductive material and can assist in dissipating heat from the light emitting elements 33, 34, 35. In such an embodiment, the bottom portion 26 functions similar to a heat sink and can be coupled to the top portion 24 by snapping into place along the sides of the top portion 24, similarly as described above, or by any other suitable fastening method such as screws, bolts, fasteners, clips, etc. The bottom portion 26 may be constructed of any material capable of functioning as a heat sink, conducting heat away from the light emitting elements 33, 34, 35, such as but not limited to aluminum. In some embodiments, as shown in FIG. 7, the bottom portion 26 comprises a plurality of fins 48 to assist with conducting heat away from the lighting unit 12. Once the bottom portion 26 is coupled to the top portion 24, the housing 22 is complete and sealed. In other embodiments, the seal is formed by the coupling of the top portion 24 and the bottom portion 26, whereby the coupling of the top portion 24 and bottom portion 26 causes a force to be applied on the gasket 36 thereby forming the seal.

An advantage of the invention is that the sealed lighting unit 20 could receive a large range of ingress protection ratings such as IP00 to IP68 or any other available rating. Some embodiments can have ingress protection ratings which are IP61 to IP68. Yet other embodiments can have a rating of IP68. When reading ingress protection ratings, the first digit indicates the level of protection that the enclosure provides against access to hazardous parts and the ingress of solid foreign objects. The second digit indicates the level of protection of the equipment inside the enclosure against harmful ingress of water. Generally, the higher the number the better the protection.

In other embodiments, the cavities 44 within the housing 22 around the light emitting elements 33, 34, 35 and the PCB 32 are filled with a sealant, which bonds to the housing 22, PCB 32, and any other component the sealant contacts within the cavity 44. The sealant may be filled into the cavities 44 through access ports (not shown) in the top portion 24 and then allowed to cure fully. It should be ensured that there are no voids or air cavities and that no sealant material is deposited on the lenses 40. In some embodiments, this sealant may be a thermoplastic hotmelt which allows for sealing of the lighting unit 20 from contaminants. For example, an embodiment of the lighting unit 20 using a thermoplastic hotmelt as a filler and sealant could receive a large range of ingress protection ratings such as IP00 to IP68 or any other available rating. Some embodiments may have ingress protection ratings which are IP61 to IP68. Other embodiments may have a rating of IP68.

Bonding of the sealant to components within the top portion 24 and filling the cavities 44 also reduces strain on connections within the lighting unit 20 such as strain on the light emitting elements 33, 34, 35 connections and conductors 28, 30. The reduction of strain is a result of the sealant hardening around the components thereby reducing movement and providing support for those connections. Utilizing both a top portion 24 and a sealant such as macromelt may provide additional rigidity.

Each lighting unit 20 can be mounted within a system housing 12 by many different methods such as but not limited to glue, clamp, bolt, weld, etc. For example, as shown in FIG. 5, the lighting unit 20 can be provided with double sided tape 54 on the bottom portion 26 of the housing 22 for mounting. In other embodiments, the lighting unit 20 can be mounted using an alternative mounting method that can be used alone or in conjunction with the double sided tape 54. The top portion 24 can also comprise a mounting hole 56 through which a screw, nail, rivet or the like can pass through to mount the lighting unit 20 to the system housing 12. The PCB 32 can be configured to comprise a PCB mounting hole in alignment with the mounting hole 56, if needed. In embodiments where a sealant is within the housing 22, the sealant is applied in such a manner that does not fill mounting hole 56, so that mounting hole 56 is free of any obstructions that may prevent the mounting of the lighting unit 20.

Lighting units 20 can be mounted within system housing 12 such that they are mounted on a surface transverse to the display surface. In some embodiments, light emitted from each of the lighting units 20 is in a fanned out pattern that emits light towards the opposing sidewall 18 and the other sidewalls 18 of the system housing 12, as well as the back surface 16 and the front surface 14 of the system housing 12. The emitted light reflects off these surfaces and uniformly lights the display face of the system housing 12. The inner surfaces of the system housing 12 may be finished with a reflective, sometimes white, coating to facilitate reflection and bouncing of emitted light to create a more uniformly lit display surface.

In embodiments wherein the plurality of lighting units 20 are daisy chained together, the lighting system 10 according to the present invention can be arranged in many different ways to allow for reducing the density of lighting units 20 or light emitting elements 33, 34, 35 in a chain of lighting units 20. In the embodiments described above, the density can be decreased by increasing the length of conductors 28, 30 between different lighting units 20.

The configuration of the lighting units 20 can be advantageous because the lighting units 20 can be easily packaged for sale and shipping. In some embodiments the packaging may be comprised of a tray 60 which can be configured to hold a plurality of lighting units 20, as shown in FIG. 10*a*-10*c*. The tray 60 may be made of plastic or any other suitable material for holding lighting units 20. A foam or plastic lid may be included over the tray 60 to prevent the lighting units 20 from being scratched or damaged during shipment. The tray 60 can further comprise indented or depressed portions 62 for each of the lighting units 20 to fit in. The lighting unit can be configured to have one or more slots 66 that correspond to the portions 62 and or tabs 64 to properly seat the lighting unit 20 in tray 60. These portions 62 can comprise tabs 64 to securely hold the lighting units 20 in the portions 62. The tabs 64 protrude from the top sides of the depressed portions 62 and function such that when a lighting unit 20 is inserted into the depressed portion 62, the tabs 64 flex outward allowing the lighting unit 20 to be received by the depressed portion 62. Once the lighting unit 20 is inserted, the tabs 64 return to their original position and protrude out from the surfaces and over the lighting unit 20 acting as a stop preventing the lighting unit 20 from falling. The lighting units 20 may also be packaged using other packaging methods such as on a reel, in a foam box or insert, in a clear plastic box or encasement, individual boxes, vacuum formed packaging, or any other suitable packaging method.

Although the present invention has been described in considerable detail with reference to certain configurations thereof, other versions are possible. Lighting units according to the invention can be many different sizes and can be used for many different applications beyond poster boxes. A separate power supply can be used for each poster box, each lighting unit, or multiple units or boxes can be powered by a single power supply. In other embodiments, a variable power supply can be used to control the intensity of the light emitters. The PCB can have different numbers of LEDs and can have different electronic components arranged in different ways. The conductors can be different lengths and instead of running uninterrupted between the units, the conductors can have connectors. This would allow the units to be supplied separately and then connected together when installed. Different types of housings or housing and heat sink configurations may be used. Different types of lenses and reflectors and configurations thereof may be used. Therefore, the spirit and scope of the invention should not be limited to the preferred versions described above.

We claim:

1. A lighting system, comprising:

a system housing including a front surface, a back surface and a plurality of sidewalls; and first and second conductors electrically connected to a plurality of lighting units within said system housing, each of said plurality of lighting units comprising:

a housing including a top portion and a bottom portion;

a plurality of light emitting elements;

a printed circuit board (PCB) within said housing, wherein said plurality of light emitting elements are mounted on said PCB;

said top portion comprising light altering characteristics, such that said light altering characteristics are housed within said housing and aligned with each of said plurality of light emitting elements; and a mounting mechanism to mount each of said plurality of lighting units to said system housing.

2. The lighting system of claim 1, wherein said top portion further comprises a plurality of lenses integral to said top portion.

3. The lighting system of claim 2, wherein each of said plurality of light emitting elements is received by a respective one of said plurality of lenses.

4. The lighting system of claim 2, wherein at least one of said plurality of lenses is shaped in the form of a trapezoid.

5. The lighting system of claim 1, wherein said top portion is a single molded piece.

6. The lighting system of claim 1, wherein said plurality of sidewalls are disposed about the perimeter of said system housing and interposed between said front surface and said back surface.

7. The lighting system of claim 1, wherein said plurality of lighting units are mounted on at least one of said sidewalls of said system housing.

8. The lighting system of claim 7, wherein each of said plurality of lighting units are configured within said system housing such that lighting units on opposing sidewalls are not in alignment with another lighting unit on an opposite sidewall.

9. The lighting system of claim 1, wherein at least one of said light emitting elements comprises a light emitting diode.

10. The lighting system of claim 1, wherein at least one of said light emitting elements comprises a high luminous flux light emitting diode emitting white light.

11. The lighting system of claim 1, said system further comprising a constant current device adapted to provide substantially the same current to each of said plurality of light emitting elements.

12. The lighting system of claim 1, wherein said plurality of lighting units are adapted to emit light out said front surface of said system housing.

13. The lighting system of claim 1, wherein said front surface comprises a transparent cover or translucent cover.

14. The lighting system of claim 13, wherein said translucent cover is adapted to disperse light from said lighting units to give the appearance that said system is illuminated by a continuous light source.

15. A lighting system, comprising:

a system housing including a front surface, a back surface and a plurality of sidewalls; and first and second conductors electrically connected to a plurality of lighting units within said system housing, each of said plurality of lighting units comprising:

a housing including a top portion and a bottom portion;

a plurality of light emitting elements;

a printed circuit board (PCB) within said housing, wherein said plurality of light emitting elements are mounted on said PCB;

said top portion comprising light altering characteristics, such that said light altering characteristics are aligned with each of said plurality of light emitting elements; and a mounting mechanism to mount each of said plurality of lighting units to said system housing, wherein said plurality of lighting units are mounted on at least one of said sidewalls of said system housing in a staggered configuration.

16. A lighting unit, comprising:

a housing including a top portion and a bottom portion, wherein said top portion comprises a plurality of lenses;

a printed circuit board (PCB) within said housing;

a plurality of light emitting element on said PCB, wherein each of said plurality of light emitting elements are arranged on said PCB to be in alignment with a respective one of said plurality of lenses, wherein said plurality of lenses are housed within said housing.

17. The lighting unit of claim 16, wherein said plurality of lenses are disposed on said PCB, such that a respective one of said plurality of light emitting elements is received by said respective one of said plurality of lenses.

18. The lighting unit of claim 17, wherein each of said plurality of lenses comprises an opening adapted to receive said respective one of said plurality of light emitting elements.

19. The lighting unit of claim 16, wherein said PCB is adapted to conduct and dissipate heat from said light emitting elements.

20. The lighting unit of claim 19, wherein said PCB comprises a metal core PCB arranged to conduct heat away from said light emitting elements.

21. The lighting unit of claim 16, wherein at least one of said light emitting elements comprises a light emitting diode.

22. The lighting unit of claim 16, wherein at least one of said light emitting elements comprises a high luminous flux light emitting diode emitting white light.

23. The lighting unit of claim 16, further comprising first and second conductors electrically connected to said lighting unit.

24. The lighting unit of claim 16, wherein said top portion and said bottom portion are adapted to be coupled to each other to form said housing.

25. The lighting unit of claim 24, said top portion further comprising extensions extending from opposing top portion sidewalls, and said bottom portion further comprising slots on opposing bottom portion sidewalls, such that said slots are configured to engage said extensions so as to couple said bottom portion and said top portion together.

26. The lighting unit of claim 16, further comprising a heat transfer pad interposed between said PCB and said bottom portion.

27. The lighting unit of claim 16, wherein said bottom portion is formed of thermally conductive material and is adapted to conduct and dissipate heat from said light emitting elements.

28. The lighting unit of claim 27, wherein said bottom portion further comprises a plurality of fins to assist with conducting and dissipating heat away from said light emitting elements.

29. The lighting unit of claim 16, wherein said housing further comprises a mounting hole, such that said lighting unit can be mounted to a structure.

30. The lighting unit of claim 29, wherein said PCB comprises a PCB mounting hole, such that said lighting unit can be mounted to a structure.

31. The lighting unit of claim 30, wherein said PCB mounting hole is aligned with said mounting hole of said housing.

32. A lighting unit, comprising:

a housing including a top portion and a bottom portion, wherein said top portion comprises a plurality of lenses, wherein said top portion and said bottom portion are adapted to be coupled to each other to form said housing;

a printed circuit board (PCB) within said housing;

a plurality of light emitting element on said PCB, wherein each of said plurality of light emitting elements are arranged on said PCB to be in alignment with a respective one of said plurality of lenses; and a gasket on said PCB, wherein said top and bottom portions of said housing are configured to apply a pressure on said gasket when said top and bottom portions are coupled;

wherein said top portion further comprising extensions extending from opposing top portion sidewalls, and said bottom portion further comprising slots on opposing bottom portion sidewalls, such that said slots are configured to engage said extensions so as to couple said bottom portion and said top portion together.

33. A lighting unit, comprising:

a housing including a top portion and a bottom portion, wherein said top portion comprises a plurality of lenses;

a printed circuit board (PCB) within said housing, a plurality of light emitting element on said PCB, wherein each of said plurality of light emitting elements are arranged on said PCB to be in alignment with a respective one of said plurality of lenses; and an insulation layer interposed between said PCB and said bottom portion.

34. A lighting unit, comprising:

a housing including a top portion and a bottom portion, wherein said top portion comprises a plurality of lenses;

a printed circuit board (PCB) within said housing;

a plurality of light emitting element on said PCB, wherein each of said plurality of light emitting elements are arranged on said PCB to be in alignment with a respective one of said plurality of lenses; and a sealant to fill cavities proximate said plurality of lenses, said PCB and said light emitting elements within said housing.

35. The lighting unit of claim 34, wherein said sealant bonds to said housing and said PCB, strengthening connections between components therein.

36. The lighting unit of claim 34, wherein said sealant is a thermoplastic hotmelt.

* * * * *